United States Patent [19]

Zahn

[11] Patent Number: 4,987,609

[45] Date of Patent: Jan. 29, 1991

[54] MILITARY SAFETY HELMET

[75] Inventor: Christian Zahn, Am Buelten 40, 3300 Braunschweig, Fed. Rep. of Germany

[73] Assignee: Schuberth-werk GMBH & Co., KG, Federal, Republic of Germany

[21] Appl. No.: 425,723

[22] Filed: Oct. 24, 1989

[51] Int. Cl.[5] ..... A42B 3/00; A62B 18/00

[52] U.S. Cl. ..... 2/6; 2/411; 2/416

[58] Field of Search ..... 2/5, 6, 410, 411, 416, 2/425

[56] References Cited

U.S. PATENT DOCUMENTS

| | | | |
|---|---|---|---|
| 1,391,753 | 9/1921 | Baier | 2/416 |
| 3,422,459 | 1/1969 | Bowers, Jr. | 2/416 |
| 3,555,560 | 1/1971 | Rascke | 2/416 |

FOREIGN PATENT DOCUMENTS

| | | | |
|---|---|---|---|
| 333524 | 3/1921 | Fed. Rep. of Germany | |
| 707963 | 7/1941 | Fed. Rep. of Germany | |
| 6602591 | 6/1965 | Fed. Rep. of Germany | |
| 7335915 | 1/1974 | Fed. Rep. of Germany | |
| 7623197 | 11/1976 | Fed. Rep. of Germany | |
| 8107236 | 3/1981 | Fed. Rep. of Germany | |
| 864280 | 4/1941 | France | 2/416 |
| 502629 | 4/1976 | U.S.S.R. | 2/416 |
| 654242 | 3/1979 | U.S.S.R. | 2/416 |
| 683718 | 9/1979 | U.S.S.R. | 2/416 |
| 522509 | 6/1940 | United Kingdom | 2/6 |
| 534207 | 3/1941 | United Kingdom | 2/6 |
| 1108502 | 4/1968 | United Kingdom | |

*Primary Examiner*—Werner H. Schroeder
*Assistant Examiner*—Michael A. Neas

[57] ABSTRACT

The invention relates to a military safety helmet with a cap resistant to bombardment and an internal band arrangement, connected firmly to the helmet cap at several points and comprised of an approximately horizontally encircling annular supporting band, a plurality of bands extending in a radiating manner from a central fastening piece on the top side of the helmet and bands for connecting the adjacent radiating bands. The internal band arrangement provides all-round impact damping, especially under the effect of shocks, and good ventilation since the bands have formed-on bosses pointing towards the inner face of the helmet cap. Above the supporting band, fastening strips extend which have no bosses and the ends of which are connected firmly to the helmet cap in such a way that the band arrangement rests against the inner face of the helmet cap via the bosses. The radiating bands are approximately the width of the bosses, and the bosses are preferably designed as hollow cylinders.

18 Claims, 2 Drawing Sheets

MILITARY SAFETY HELMET

BACKGROUND OF THE INVENTION

The invention relates to a military safety helmet with a helmet cap resistant to bombardments and with a band arrangement, as internal equipment, connected firmly to the helmet cap at several points and composed of an approximately horizontally encircling annular supporting band and of bands which extend in a radiating manner from the top side and the ends of which are connected firmly to the supporting band.

In military safety helmets, a known band arrangement is composed of textile bands which are connected to the helmet cap, preferably by riveting, at several, for example, at six, points in the region of the annular supporting band. The purpose of the band arrangement is to keep the skull away from the cap, in order, under the effect of an impact, to avoid transmitting the impact energy directly through the cap to the skull of the helmet wearer. It is possible for the skull to come in contact with the top of the helmet cap only when the textile bands have lengthened to a considerable extent, thereby expending some of the impact energy. Since the band arrangement is fastened directly to the helmet laterally, lateral impacts can be transmitted directly to the skull of the helmet wearer. Since bombardments of the helmet cap are possible and likely from all sides equally, band arrangements of this type are unsuitable for damping the bombardment energy of a wide variety of possible bombardments before it is transmitted to the skull of the helmet wearer.

There are known work safety helmets, the internal equipment of which must satisfy requirements fundamentally different from those in military safety helmets. For this internal equipment, it is known to produce the band arrangement from plastic and, for damping violent impacts on the helmet, to provide, on the outside of the plastic bands, bosses which experience plastic deformation under high impact effect and which thus transmit the impact energy to the skull of the helmet wearer only after it has been damped. It is not possible for bosses to be provided where the radiating bands are fastened to the helmet cap itself. As these points, therefore, impact energies are transmitted to the skull without being damped. The functioning of the internal equipment of work safety helmets of this type is based essentially on the fact that the radiating bands are fastened to the helmet cap and the supporting ring remains movable. In DE-U No. 76 23 197 there is an additional band which makes the connection between the radiating bands and the supporting ring and which is itself not fastened to the helmet cap. This band is located on the rear side of the helmet. The supporting ring is itself connected firmly to the helmet cap on the front side of the helmet. Padding is provided at this location.

Internal equipment known from the work safety helmets cannot be transferred directly to military safety helmets. All-round impact damping could be achieved by means of an inserted Styropor cap in the manner of a motorcycle crash helmet. This design cannot be adopted, however, because it does not allow a sufficient ventilation of the helmet interior. The interior ventilation of crash helmets is based on the capture of the relative wind; therefore, this possibility is not available on military safety helmets.

G.B. Patent No. 1,108,502 discloses an internal equipment for a work safety helmet, which is composed of elastically flexible strips fitted with rectangular ribs close to one another. Two Y-shaped strips extend from an encircling headband in a curve matching the form of the cap to two fastening points located opposite one another. A high density of the shock absorbing ribs cannot be achieved thereby, because the bands are relatively wide and a larger number of bands would result in an excessively high weight of the internal equipment. This internal equipment is not intended for military safety helmets.

SUMMARY OF THE INVENTION

It is therefore an object of the present invention to provide an improved military safety helmet.

It is a particular object of the invention to provide such a helmet in which all-round impact damping, especially under the effect of shocks, is obtained with the use of a band arrangement allowing good ventilation.

Another object of the invention resides in the provision of an effective yet lightweight damping arrangement for use in headgear.

In accomplishing the foregoing objects, an internal band arrangement forming a supporting basket for a military safety helmet is provided, comprising:

(a) an encircling annular supporting band;

(b) a plurality of radiating bands extending from a central fastening piece to the supporting band;

(c) at least one band connecting adjacent members of pairs of the adjacent radiating bands;

(d) bosses formed on the annular and radiating bands so as to point towards the inner face of the helmet cap, the radiating bands having a width substantially the same as the bosses; and (e) means, including fastening strips extending from at least some of the radiating bands, for firmly connecting the internal band arrangement to the helmet cap so that the band arrangement rests against the inner face of the helmet cap via at least some of the bosses.

Also provided is a helmet embodying the above-described internal band arrangement.

Further objects, features and advantages of the present invention will become apparent from the detailed description of preferred embodiments that follows.

BRIEF DESCRIPTION OF THE DRAWINGS

The invention will be explained in detail below by reference to the attached drawings.

In the drawings.

DETAILED DESCRIPTION OF THE PREFERRED EMBODIMENTS

Figure 1:
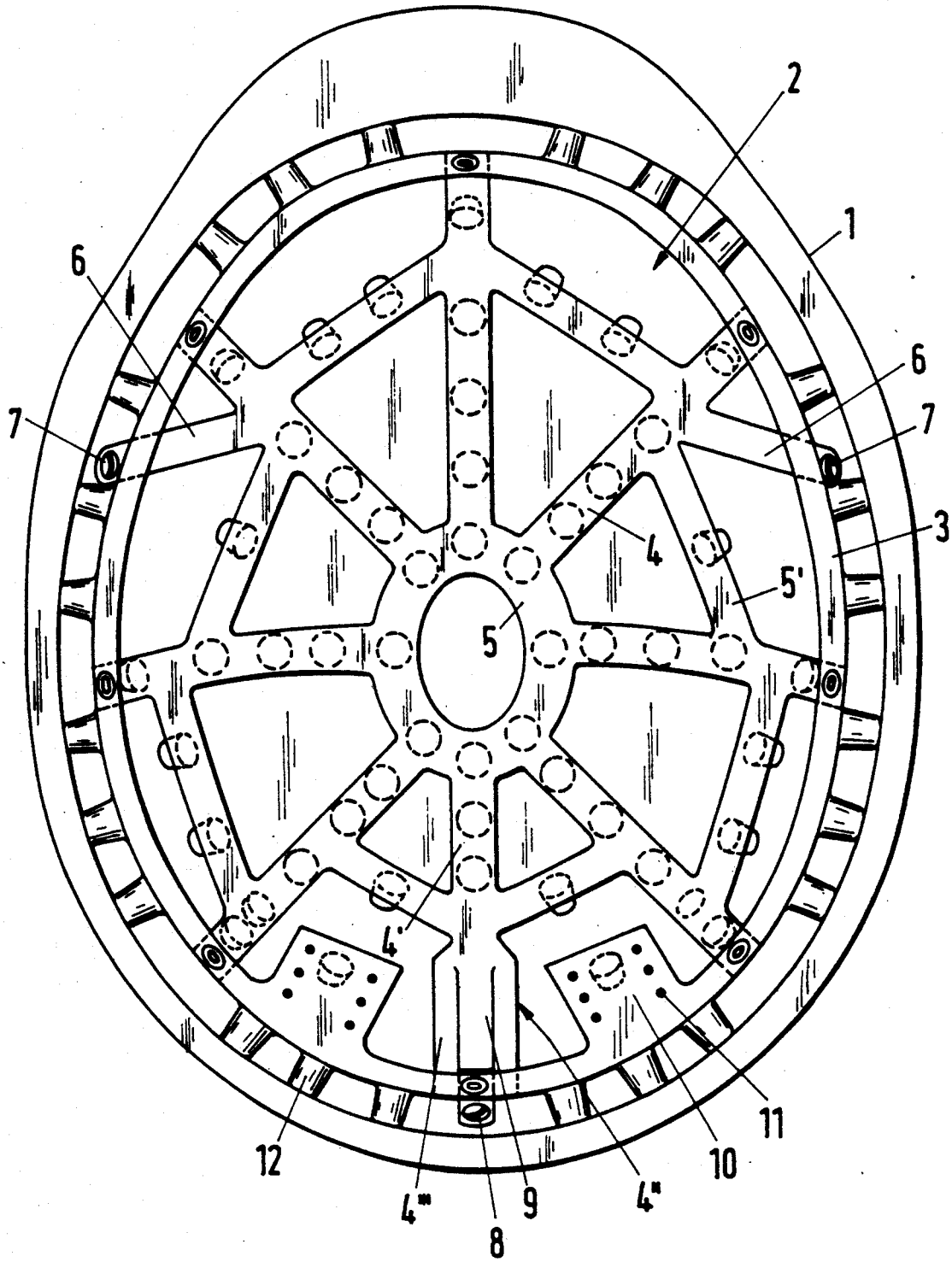
FIG. 1 is a view of the inner face of a military safety helmet.

According to the present invention, a significant improvement in military safety helmets is achieved because the band arrangement is made of plastic and forms a supporting basket, because all the bands of the supporting basket have formed-on bosses pointing towards the inner face of the helmet cap and because there extend from the bands, above the supporting band, fastening strips which have no bosses and the ends of which are connected firmly to the helmet cap.

The band arrangement according to the invention is inherently relatively stable, because the ends of the band arrangement are connected firmly to the supporting band. Neither the radially extending bands nor the supporting band are fastened directly to the helmet cap. On the contrary, fastening takes place by means of the fastening strips which extend from the bands above the supporting band. The design according to the invention of the band arrangement makes it possible to provide, on all sides, formed-on bosses which are arranged between the bands and the helmet cap and which preferably rest against the inner face of the helmet cap.

The plastic basket according to the invention thus constitutes a unitary part which has an impact-damping property because of the bosses and which is fastened to the helmet by means of the fastening strips. The plastic basket according to the invention therefore has, on the one hand, the properties of a Styropor cap and, on the other hand, the properties of conventional internal equipment for work safety helmets, in which the supporting band is movable in relation to the radially extending bands.

In a preferred embodiment, the fastening strips extend from radiating bands. At the same time, the fastening strips have a length which corresponds approximately to half the length of the radiating bands.

To obtain a suitable damping behavior, it can be expedient if the bosses have different heights, and two different heights are usually sufficient. The damping effect is initially determined by the higher bosses alone, while a more pronounced damping effect is achieved when the lower bosses also experience subsequent deformation.

It is preferable to provide only three fastening strips, so that only three fastening means, for example, rivets, pass through the helmet cap. Appropriately, two fastening points are provided laterally in the front region and one fastening point is provided centrally at the rear.

The stability of the plastic basket and a uniform damping effect are obtained if two adjacent bands are connected to one another by means of at least one connecting strip. If, in a preferred way, eight radiating bands are provided, then, together with the connecting bands, a sufficiently uniform distribution of the bosses and therefore of the damping resistance can be obtained.

The bosses can preferably have a diameter of approximately 10 mm. With this dimension, a desired damping effect for the severest types of bombardment coming under consideration can be obtained, while the weight of the supporting basket is at the same time as low as possible, if the radiating bands have approximately the width of the bosses. The bosses can be designed as hollow cylinders and, if appropriate, taper conically towards the helmet cap, in order to achieve a progressive increase of the damping effect.

Figure 2:
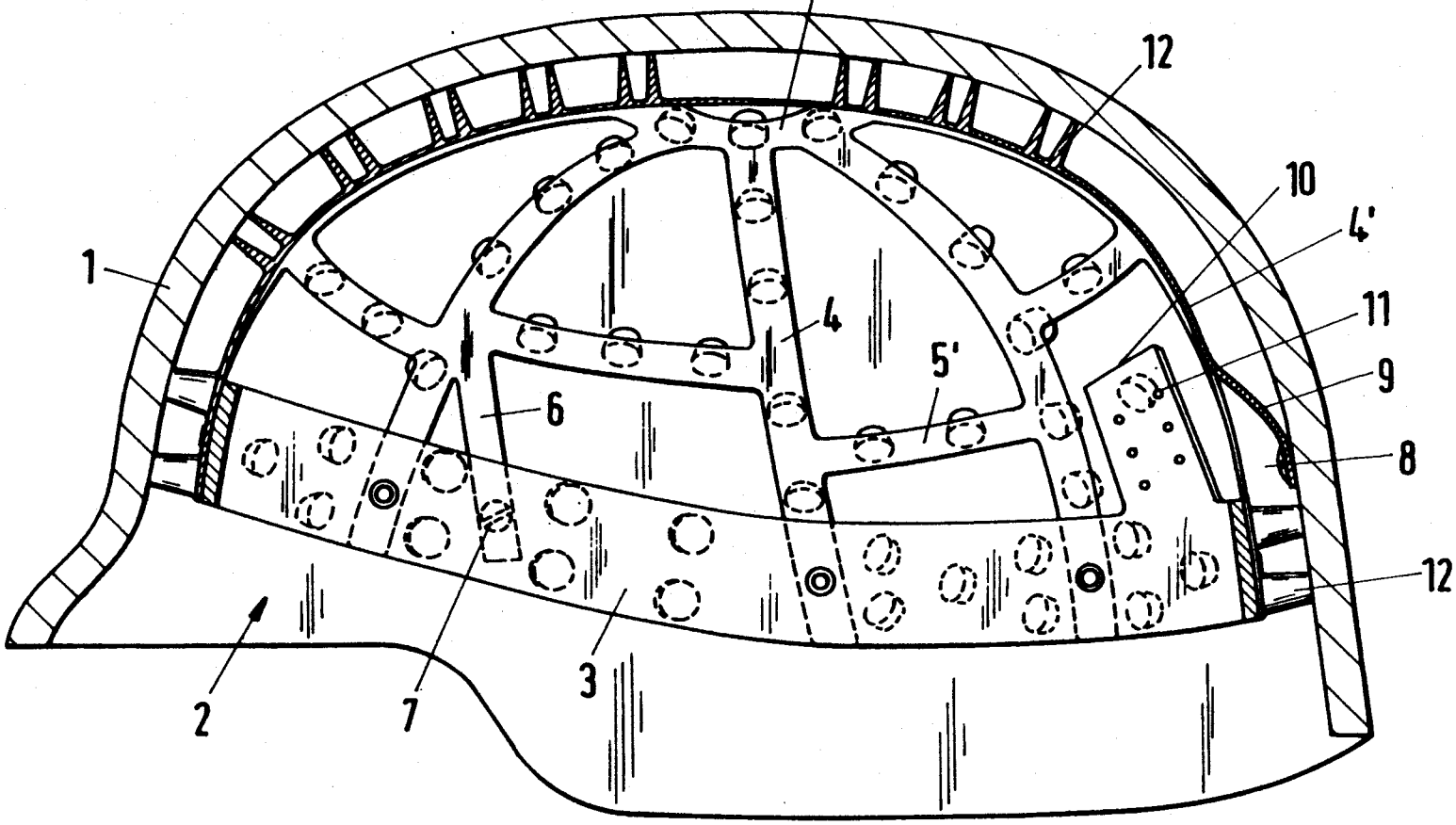
FIG. 2 is a longitudinal section through the helmet according to FIG. 1.

The preferred embodiment of a military safety helmet illustrated in FIGS. 1 and 2 has a helmet cap 1, on the inner face of which a supporting basket 2 is fastened to form internal equipment. The supporting basket 2 is produced from plastic and is composed of an approximately horizontally encircling annular supporting band 3 and of eight radially extending bands 4 which are connected firmly to the supporting band 3, for example by riveting, and which extend approximately radially from a central elliptical fastening ring 5 on the top side of the helmet. Two radial bands 4 are connected respectively to one another in each case by means of a connecting band 5', these being aligned approximately tangentially and joining the radial bands 4 approximately at half the length of or offset outwardly relative to the latter.

Two fastening strips 6 extend obliquely rearwardly from the radial bands to lateral fastening points 7, where they are fastened to the helmet cap 1, for example by riveting. A third fastening point 8 is located centrally on the rear side of the helmet. A fastening strip 9 connected to this is bent out of a portion 4", widened in this region, of a radial band 4' extending rearwardly, so that the connection between the radial band 4' and the annular supporting band 3 is made via two lateral strips 4'''.

Two tabs 10 projecting obliquely upwardly are formed on the supporting band 3 laterally relative to the rearwardly directed radial band 4' and possess in pairs holes 11 for fastening a netting strip intended to extend over the helmet in the longitudinal direction and improve the wearing comfort.

Both the radial bands 4 and the annular supporting band 3 have a plurality of bosses 12 which are arranged next to one another in the longitudinal direction of the bands and are designed as hollow cylinders, as shown in FIG. 2, and which taper somewhat conically upwards.

The entire supporting basket 2 therefore rests against the face of the helmet cap 1 via the bosses 12.

What is claimed is:

1. An internal band arrangement forming a supporting basket for a military safety helmet with an outer cap resistant to bombardments, comprising:
   (a) an encircling annular supporting band;
   (b) a plurality of bands extending in a radiating manner from a central fastening piece adapted to be located near the top of said helmet, the ends of said radiating bands being connected to said supporting band;
   (c) at least one band connecting adjacent members of pairs of said adjacent radiating bands;
   (d) bosses formed on said supporting band and said radiating bands so as to point towards an inner face of said helmet cap, the radiating bands having a width substantially the same as said bosses; and
   (e) means, including three fastening strips extending from at least some of said radiating bands, for firmly connecting said internal band arrangement to said helmet cap so that said band arrangement rests against the inner face of said helmet cap via at least some of said bosses to form a supporting basket, wherein two of said fastening strips are arranged laterally corresponding to a front region of the helmet cap and one of said fastening strips is arranged centrally corresponding a rear region of the helmet.

2. An internal band arrangement as recited in claim 1, wherein at least some of said bosses have different heights.

3. An internal band arrangement as recited in claim 1, wherein said bosses are designed as hollow cylinders.

4. An internal band arrangement as recited in claim 3, wherein said bosses taper conically toward the helmet cap.

5. An internal band arrangement as recited in claim 1, comprising at least eight of said radiating bands.

6. An internal band arrangement as recited in claim 1, wherein said connecting bands also include said bosses and are essentially the same width as said bosses.

7. A safety helmet comprising a rigid outer cap member resistant to bombardments and an internal band arrangement fastened inside of said cap member, wherein said band arrangement comprises:
   (a) an encircling annular supporting and;

(b) a plurality of bands extending in a radiating manner from a central fastening piece adapted to be located near the top of said helmet, the ends of said radiating bands being connected to said supporting band;

(c) at least one band connected adjacent members of pairs of said adjacent radiating bands;

(d) bosses formed on said supporting band and said radiating bands so as to point towards an inner face of said helmet cap; and (e) means, including three fastening strips extending from at least some of said radiating bands, for firmly connecting said internal band arrangement to said helmet cap so that said band arrangement rests against the inner face of said helmet cap via at least some of said bosses to from a supporting basket, wherein two of said fastening strips are arranged laterally corresponding to a front region of the helmet cap and one of said fastening strips is arranged centrally corresponding to a rear region of the helmet.

8. A helmet as recited in claim 7, wherein said radiating bands are approximately of the same width as said bosses.

9. A helmet as recited in claim, 8, wherein said connecting bands also contain said bosses and are essentially the same width as said bosses.

10. An internal band arrangement forming a supporting basket for a military safety helmet with an outer cap resistant to bombardments, comprising:

(a) an encircling annular supporting band;

(b) a plurality of bands extending in a radiating manner from a central fastening piece adapted to be located near the top of said helmet, the ends of said radiating bands being connected to said supporting band;

(c) at least one band connecting adjacent members of pairs of said adjacent radiating bands;

(d) bosses formed on said supporting band and said radiating bands so as to point towards an inner face of said helmet cap, the radiating bands having a width substantially the same as said bosses; and (e) means, including fastening strips extending from at least some of said radiating bands, for firmly connecting said internal band arrangement to said helmet cap so that said band arrangement rests against the inner face of said helmet cap via at least some of said bosses to form a supporting basket, wherein one of said fastening strips is bent out of the material of one of said radiating bands.

11. An internal band arrangement as recited in claim 10, wherein at last some of said bosses have different heights.

12. An internal band arrangement as recited in claim 10, wherein said bosses are designed as hollow cylinders.

13. An internal band arrangement as recited in claim 10, wherein said bosses taper conically toward the helmet cap.

14. An internal band arrangement as recited in claim 10, comprising at least eight of said radiating bands.

15. An internal band arrangement as recited in claim 10, wherein said connecting bands also include said bosses and are essentially the same width as said bosses.

16. A safety helmet comprising a rigid outer cap member resistant to bombardments and an internal band arrangement fastened inside of said cap member, wherein said band arrangement comprises:

(a) an encircling annular supporting band;

(b) a plurality of bands extending in a radiating manner from a central fastening piece adapted to be located near the top of said helmet, the ends of said radiating bands being connected to said supporting band;

(c) at least one band connecting adjacent members of pairs of said adjacent radiating bands;

(d) bosses formed on said supporting band and said radiating bands so as to point towards an inner face of said helmet cap; and (e) means, including fastening strips extending from at least some of said radiating bands, for firmly connecting said internal band arrangement to said helmet cap so that said band arrangement rests against the inner face of said helmet cap via at least some of said bosses to form a supporting basket, wherein one of said fastening strips is bent out of the material of one of said radiating bands.

17. A helmet as recited in claim 16, wherein said radiating bands are approximately of the same width as said bosses.

18. A helmet as recited in claim 16, wherein said connecting bands also include said bosses and are essentially the same width as said bosses.

* * * * *